United States Patent [19]

Bradt

[11] Patent Number: 4,722,701

[45] Date of Patent: Feb. 2, 1988

[54] FUSE BLOCK FOR MINIATURE PLUG-IN BLADE-TYPE FUSE

[75] Inventor: Douglas H. Bradt, Elkhart, Ind.

[73] Assignee: Todd Engineering Sales, Inc., Elkhart, Ind.

[21] Appl. No.: 912,277

[22] Filed: Sep. 29, 1986

[51] Int. Cl.[4] ..... H01R 9/24

[52] U.S. Cl. ..... 439/718; 439/721; 439/724

[58] Field of Search ..... 339/176 M, 198 R, 198 G, 339/198 H, 198 J, 198 S, 258 F, 263 R, 263 L, 22 B; 439/113, 114, 212, 213, 682, 686, 687, 690, 691, 698, 709–724, 801, 809–815, 830–833, 845, 849, 850, 856, 857

[56] References Cited

U.S. PATENT DOCUMENTS

| | | | |
|---|---|---|---|
| 2,122,819 | 7/1938 | Lazich | 439/678 |
| 2,748,365 | 5/1956 | Speck | 439/723 |
| 2,905,923 | 9/1959 | Hammerly | 439/723 |
| 3,171,708 | 3/1965 | Salomone | 439/724 |
| 3,171,888 | 3/1965 | Stanback | 439/721 |
| 3,538,492 | 11/1970 | Genovese | 339/272 A |
| 3,652,977 | 3/1972 | Feldberg | 339/198 R |
| 3,693,137 | 9/1972 | Brumfield | 439/723 |
| 3,702,457 | 11/1972 | Fujita | 339/198 G |
| 3,706,960 | 12/1972 | Grenda | 339/258 R |
| 3,710,308 | 1/1973 | Horwell | 439/723 |
| 3,993,395 | 11/1976 | Taylor | 339/198 H |
| 4,082,408 | 4/1978 | Angelis | 339/198 G |
| 4,210,379 | 7/1980 | Vachhani et al. | 339/198 G |
| 4,214,801 | 7/1980 | Cairns et al. | 339/59 R |
| 4,221,456 | 9/1980 | Cairns et al. | 339/223 R |
| 4,432,594 | 2/1984 | Daggett | 339/258 F |
| 4,466,683 | 8/1984 | Ballarini | 339/125 R |
| 4,475,783 | 10/1984 | Borzoni | 339/19 |
| 4,560,227 | 12/1985 | Bukala | 339/147 R |

FOREIGN PATENT DOCUMENTS

| | | | |
|---|---|---|---|
| 2843095 | 4/1979 | Fed. Rep. of Germany | 339/176 M |

*Primary Examiner*—Gil Weidenfeld
*Assistant Examiner*—Gary F. Paumen
*Attorney, Agent, or Firm*—David Scott Saari

[57] ABSTRACT

A fuse block for miniature plug-in blade-type fuses comprising a multi-position bussed fuse holder and a plurality of single-connect fuse holders held within a block comprising a floor and a cage. The fuse block features individual terminal boxes for connecting wires to the single-connect fuse holders. The fuse block is expandable by adding one or more floor extensions, additional single-connect fuse holders, a longer bussed fuse holder, and one or more additional cages.

11 Claims, 15 Drawing Figures

FUSE BLOCK FOR MINIATURE PLUG-IN BLADE-TYPE FUSE

BACKGROUND OF THE INVENTION

1. Field of the Invention

This invention relates to fuse terminal blocks for miniature, plug-in, blade-type fuses.

2. Description of Related Art

The electrical systems of automobiles, recreational vehicles, certain types of recreational boats and other applications using direct current usually include fuses to protect the system. One type of fuse that has become popular for such applications is the miniature, plug-in, blade-type fuse. Examples of this type of fuse are illustrated in U.S. Pat. No. 3,909,767 to Williamson, et al., U.S. Pat. No. 4,224,592 to Urani, et al., and U.S. Pat. No. 4,504,016 to Viola, et al.

Various fuse terminal blocks have been developed to allow the connection of blade fuses with other components of electrical system. One feature of these fuse blocks usually is a fuse holder that allows the fuse to be connected electrically to wires leading to other components of the electrical system. Often, particularly in fuse blocks for use in automobiles, the fuse block is designed so that the fuses are arranged on the front surface of the block while the wires connected to the fuse holders exit from the rear of the fuse block. Further, the wires often are connected to the fuse holders by crimping prongs attached to the fuse holders. This combination of rear wire exiting and attachment of wires by crimping results in a fuse block that is inconvenient to service, or more particularly, difficult to modify.

In the recreational vehicle industry and similar industries, it is not uncommon for value-added manufacturers, customizers, or electrically handy owners to want to modify an electrical system. The typical automobile-type fuse terminal block does not have the features to allow for the easy and convenient modification of an electrical system. Such fuse blocks do not allow easy access to all block components, especially to the wires exiting from the back of the fuse block or to the fuse holders. Further, such fuse blocks usually are not designed to be expandable to accommodate additional or modified components. Further still, such fuse blocks usually are not designed with universal applications and installations in mind but are designed for one specific application and require specific mounts and connections for installation.

Some fuse holder assemblies feature a bus bar to allow electrical connection between a single electrical terminal and a plurality of fuse holders. In some cases, as in U.S. Pat. No. 4,432,594 to Daggett, the bus comprises a plurality of parts held together with fasteness such as rivets. In such cases, the fastness may increase the electrical resistance of the bus, causing loss of power, increased heating or failure of the bus connection. In other cases, as in U.S. Pat. No. 4,221,456 to Cairns, et al., the bus comprises a series of fuse holders that are formed by the folding of tabs extending from a strip of electrically conductive material. Fuse holders of this type are relatively difficult to manufacture, requiring multiple folding or crimping steps, and may be prone to jamming or the bending of the fuse blade.

An ideal fuse block for applications requiring modification of the fuse block after initial installation would be a fuse block made of modular components. Modular fuse carriers have been disclosed by Ballarini in U.S. Pat. No. 4,466,683 and by Bukale in U.S. Pat. No. 4,560,227; however, the fuse blocks disclosed in these patents share the common limitation of the fuse blocks of more conventional design in that there is no convenient access to the wires of fuse holders of the fuse block.

SUMMARY OF THE INVENTION

This invention recognizes that fuse terminal blocks for use in recreational vehicles and the like should allow for modification or expansion of the electrical system. Additionally, an object of this invention is to provide a fuse block where components of the fuse block are easily accessable to persons who service, upgrade, modify or expand the electrical system of which the fuse block is a part.

A further object of the invention is to provide a fuse block that can be assembled from a few basic components, thus providing a fuse block that is simple to manufacture and further that is simple to install.

Yet another object of the invention is to provide means of electrically connecting fuses to other electrical components with fuse holders that are relatively easy to manufacture, assemble and use and which are not bussed by means of parts hold together with fasteners and which are not prone to jamming or the bending of the fuse blades.

These and other objects of the invention are accomplished by providing a fuse terminal block that may be assembled from five basic components, viz., a floor, a cage, a bus bar having a plurality of fuse holders attached thereto, a single-connect fuse holder and a main terminal lug, and an optional sixth component, a floor extension. The fuse block that I have invented is expandable and easily modified. Specifically, if additional positions for fuses are required, a floor extension, a cage, additional single-connect fuse holders and a longer bus bar may be added to an existing fuse block assembly. Further, the connections to the fuse block may be made from the top surface of the fuse block. Thus installation of the fuse block and subsequent servicing, upgrading or modification of the block are more simple and convenient than with other types of fuse blocks.

DESCRIPTION OF THE PREFERRED EMBODIMENTS

Figure 1:
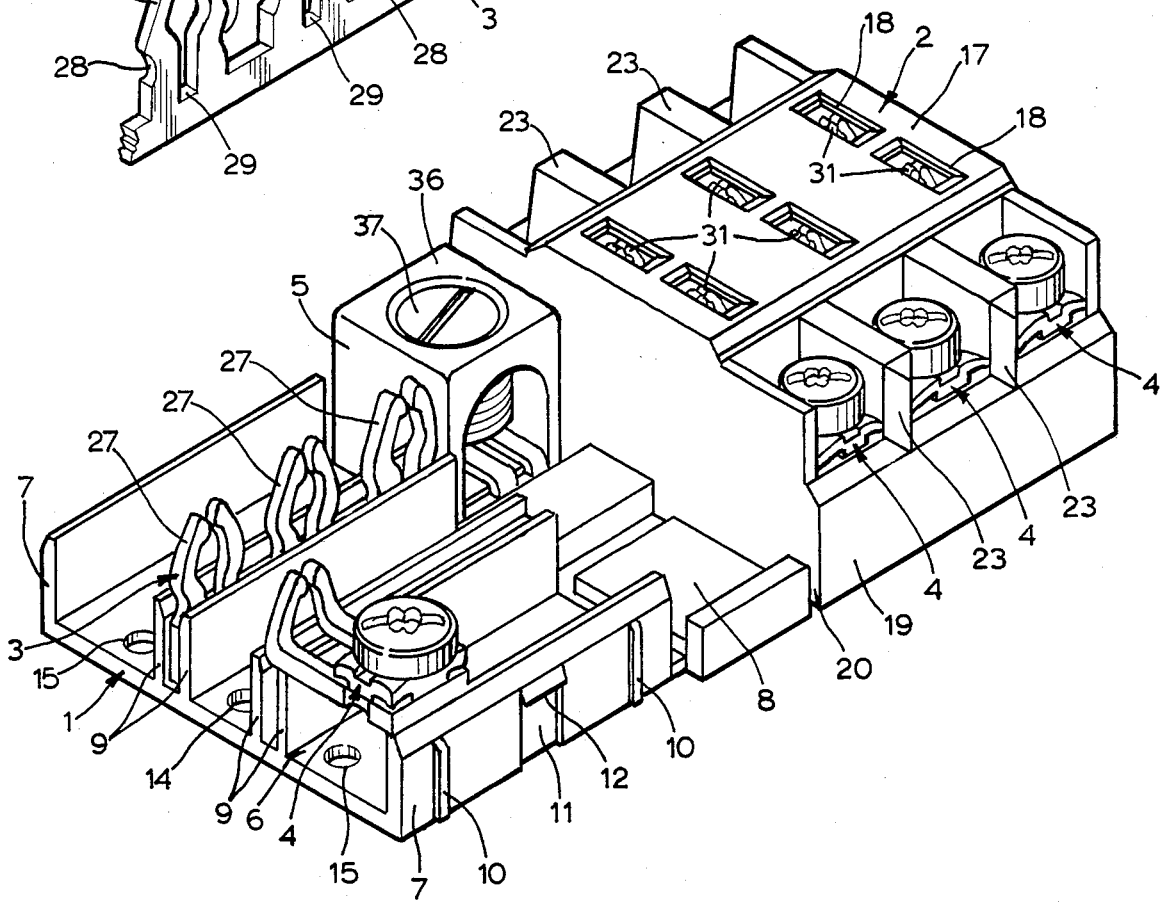
FIG. 1 is a perspective view of a partially assembled fuse block.

A simple embodiment of the fuse block for miniature plug-in blade-type fuses that I have invented is shown partially assembled in FIG. 1. When fully assembled, this fuse block would accomodate up to six fuses. The fuse block of this embodiment may be assembled from the following components: a floor 1, two cages 2 (only one of which is shown in FIG. 1), a seven-position bussed fuse holder 3, six single-connect fuse holders 4 (four of which are shown in FIG. 1) and a main terminal lug 5.

Figure 4:
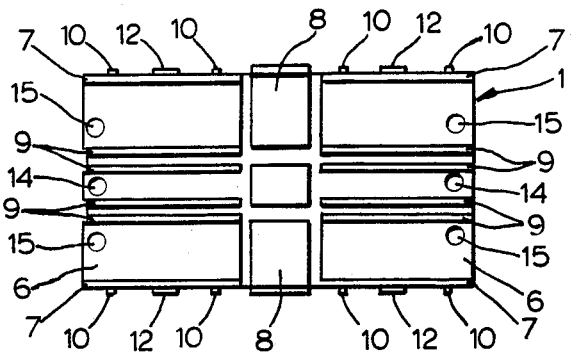
FIGS. 4, 5 and 6 are respectively top, side and end elevational views of a floor.
Figure 5:
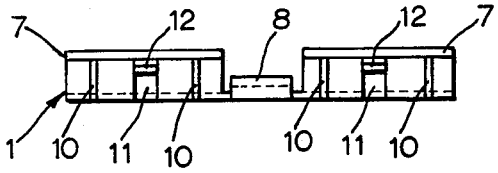
Figure 6:
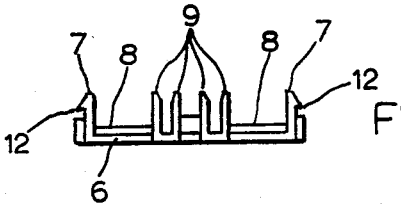
Figure 7:
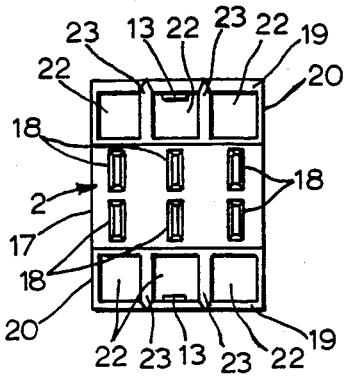
FIGS. 7, 8, 9 and 10 are respectively top, bottom, side and end elevational views of a cage.
Figure 8:
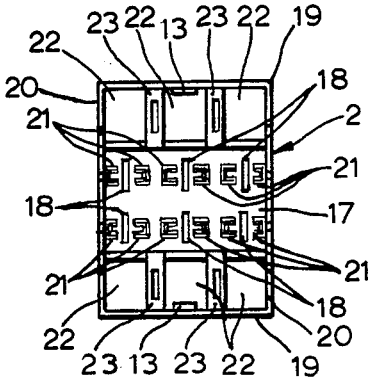
Figure 9:
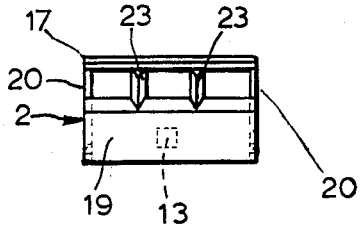
Figure 10:
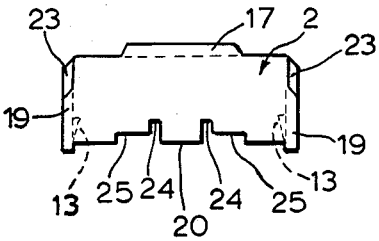

As seen in FIGS. 4 through 6, the floor 1 may be made as a single unit from molded plastic or other suitable material. The floor 1 has a high degree of symmetry about a vertical median plane through the two ends and and about a vertical median plane through the two sides. The floor 1 comprises a base 6, sides 7, a main terminal platform 8, and fuse holder positioning members 9. The floor sides 7 are provided with spacing members 10 to provide a proper fit to the cage 2, and an indentation 11 and tab 12 which are engaged by a corresponding tab 13 on cage 2 during assembly. Further, the base 6 is provided with mounting holes 14 and holes 15 which allow the addition of an optional floor extension 16.

As seen in FIGS. 7 through 10, the cage 2 may be made as a single unit from molded plastic or the like and has median vertical planes of symmetry through the two sides and through the two ends. The cage 2 comprises a top 17 in which are formed three pairs of rectangular openings 18, lower cage sides 19, and ends 20. The openings 18 are of a size and position to allow insertion of a blade-type fuse and are beveled to provide easier insertion of said fuse. The openings 18 are flanked on the bottom surface of the top 17 by squared-U-shaped fuse holder positioning members 21. The cage 2 further is provided with six terminal box openings 22 which are partially defined by parts of the end 20 of cage 2 and by box partitions 23. The lower cage side 19 is provided with a tab 13 which engages tab 12 of floor 1 or floor extension 16 during assembly. The end 20 is provided with indentations 24 to accomodate the bus bar portion of a bussed fuse holder 3 and with indentations 25 to accomodate the addition of a floor extension 16.

Figure 2:
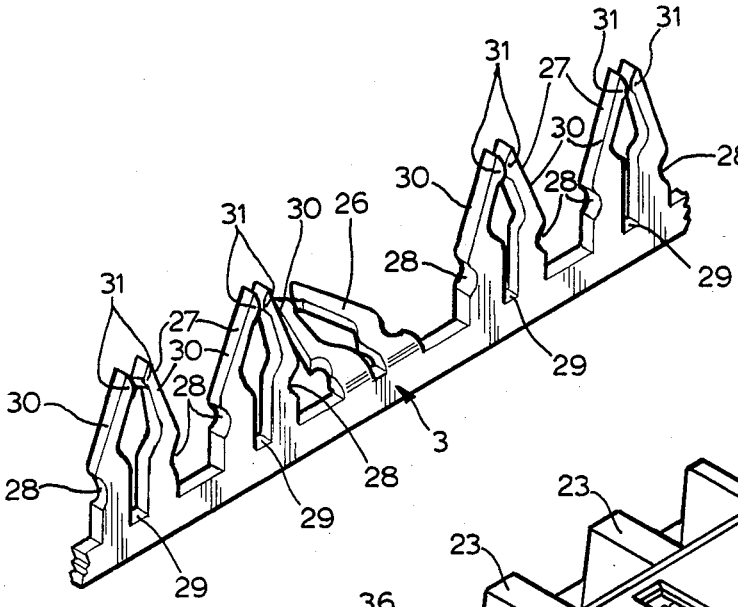
FIG. 2 is a partial perspective view of a bussed fuse holder.

The center portion of a multi-position bussed fuse holder 3 is shown in FIG. 2. For the fuse holder shown in FIG. 1, a seven-position bussed fuse holder 3 may be used. As shown in FIGS. 1 and 2, the centermost "fuse holder" 26 is bent at an approximately right angle with respect to the other fuse holders 27 to form a bus connect member 26 which may be inserted into the main terminal lug 5. This center placement of said bus connect member 26 is preferred over an end placement as the center placement configuration allows the delivery of approximately twice the current through the bussed fuse holder. The bussed fuse holder 3 may be made out of a highly conductive material such as a metal, preferrably copper or a highly conductive copper alloy, and may be plated or surface coated to inhibit corrosion. The individual fuse holders 27 comprise a side indentation 28, center indentation 29, fuse holder arms 30 and contact points 31. The configuration as shown in FIG. 2 provides a leaf spring action for gripping a blade of a miniature blade-type fuse and a contact point for electrical connection to said blade. Further, said contact points 31 comprise points of pivot for said fuse blade. Said contact points 31 provide an anti-jamming function in that said points 31 allow the blade of a fuse to be inserted from an angled direction of entry and allow the blade of an inserted fuse to be pivoted from side to side from the usual, vertical, at-rest position. This configuration prevents the jamming of the fuse blade during insertion of removal of the fuse or the spreading of the gap between said contact points 31, and provides a constant gripping force and constant electrical connection.

Figure 3:
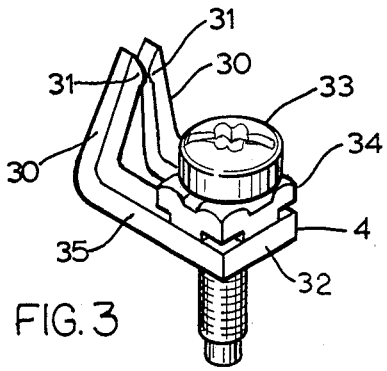
FIG. 3 is a perspective view of a single-connect fuse holder.

A single-connect fuse holder 4 is shown in FIG. 3. Said fuse holder 4 comprises a base 32 to which is attached a captive screw 33, a floating captive washer 34, and a pair of torsion arms 35. To each of said torsion arm 35 is attached a fuse holder arm 30, having a contact point 31. All of the components of the fuse holder 4 preferably are made from a highly electrically conductive material such as a metal, and the fuse holder 4 may be plated or surface coated to inhibit corrosion. The configuration as shown in FIG. 3 provides a torsion spring action for gripping the blade of a miniature blade-type fuse and a contact point for electrical connection to said blade.

Electrical connection to the bussed fuse holder 3 preferably is made with a main terminal lug 5, comprising a terminal box 36 and a terminal screw 37. Other means of connecting a wire to bussed fuse holder 3 may be used, for example clamping a wire to part of the bus contact member 26 or soldering a wire to said member 26.

The interrelationship of the components of the fuse block that I have invented is best illustrated by the following description of the assembly and use of the fuse block.

Figure 14:
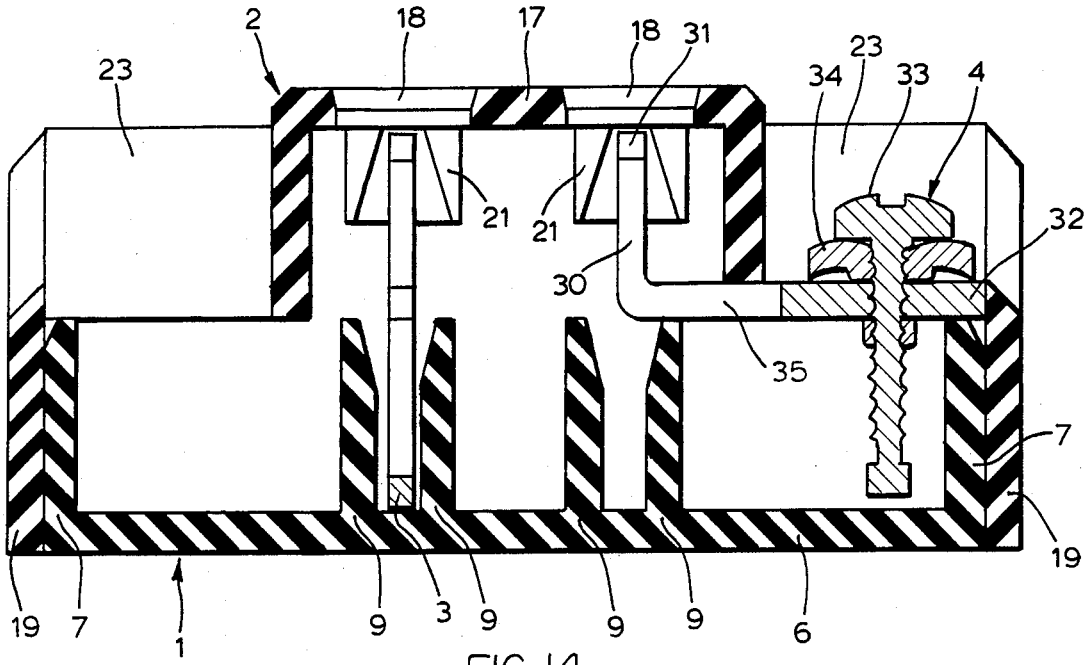
FIG. 14 is a sectional elevational view of an assembled fuse block where the sectioning has been done approximately at the position of the plane of insertion of a fuse.

Returning now to FIGS. 1 and 14, to assemble a fuse block from the components described previously, the bent over bus connect member 26 of a bused fuse holder 3 is inserted into the terminal box 36 of a main terminal lug 5, and the lug 5 is held in place by tightening terminal screw 37. The bussed fuse holder 3 is inserted into the space between a pair of fuse holder positioning members 9 of a floor 1 so that the main terminal lug 5 rests on a main terminal platform 8. Three single-connect fuse holders 4 are placed into a cage 2 so that the ends of the fuse holder arms 30 rest between pairs of fuse holder positioning members 21 and so that the heads of the captive screws 33 and captive washers 34 extend through the terminal box openings 22. The cage and fuse holder subassembly is attached to the floor 1 and is held in place by contact between tabs 12 of floor 1 and tabs 13 of cage 2. When assembled in the fashion, the ends of the fuse holder arms 30 of the bussed fuse holder 3 rest between pairs of fuse holder positioning members 21 of cage 2. The single-connect fuse holders 4 are held in place by the side 7 of floor 1 and lower side 19 of cage 2 making contact with fuse holder base 32 and by a fuse holder positioning member 9 of floor 1 making contact with a torsion arm 35. A second cage and fuse holder subassembly is assembled as described previously from a cage 2 and three single-connect fuse holders 4 and is attached to the floor 1 as described above.

Up to six miniature blade-type fuses may be inserted into the fuse block of this embodiment by inserting the fuse blades into the openings 18 of cage 2 and into the fuse holders immediately below said openings 18. Electrical connection to the individual fuses is accomplished by connecting wires to a captive screw 33 of a single-connect fuse holder 4. The combination of captive screw 33, captive washer 34, the base 32 of fuse holder 4 and the terminal box components of the cage 2 provides a method of connecting a wire to screw 33 without bending a wire around said screw 33. Unscrewing screw 33 raises said captive washer 34 and creates a space into which a wire may be inserted. Tightening screw 33 onto a wire provides a connection wherein a wire is held within a box comprising said captive washer 34, base 32 and the box components of the cage 2. Said connection may be accomplished from the front of top surface of the fuse block in that no access to the bottom surface of the fuse block is required. Further, said means of connection allow for the simple removal of one wire and insertion of another wire should it be necessary to change or modify the electrical system of which the fuse block is a part. Further still, said connection is protected from electrical shorts caused by stray wire filaments or the like by the terminal box partitions 23 and other parts of the cage 2.

Electrical connection to the fuses via bussed fuse holder 3 is accomplished by unscrewing terminal lug screw 37, inserting a wire into the terminal box 36 and compressing said wire and bus connect member 26 by tightening screw 37 to cause firm electrical contact. It may be seen that the insertion of fuses and the wiring of the fuse block may be accomplished from the top surface of the fuse block and that under normal circumstances the installation or subsequent modification of the fuse block may be accomplished without removing the fuse block from a fuse panel or like supporting means.

A second preferred embodiment of the fuse block that I have invented provides for those circumstances where some or all of the fuses must not be interconnected by way of a common bus. In this embodiment, the fuse block is assembled from the components described previously except that either (1) one or more of the fuse holders 27 of the bussed fuse holder 3 are removed, for example by removing one or more pairs of fuse holder arms 30 or by using a bussed fuse holder 3 having fewer than six fuse holders 27, and single-connect fuse holders 4 are substituted for the fuse holders 27 that are removed; or (2) by eliminating the bussed fuse holder 3 and main terminal lug 5 and substituting six single-connect fuse holders 4 for the fuse holders 27 of the bussed fuse holder 3. The fuse block of this embodiment may be used as described previously except that some or all of the electrical connections to the blade-type fuses are made by way of pairs of terminals comprising the screws 33 of single-connect fuse holders 4.

A third preferred embodiment of the fuse block that I have invented makes use of the floor extension 16 to accomodate more than six fuses.

Figure 11:
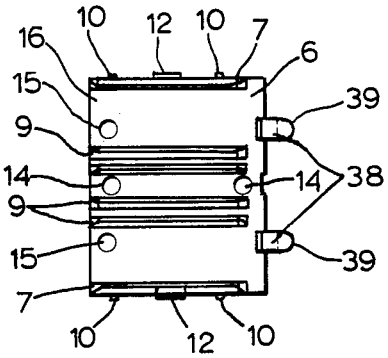
FIGS. 11, 12 and 13 are respectively top, side and end elevational views of a floor extension.
Figure 12:
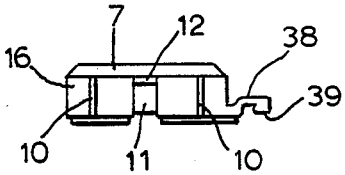
Figure 13:
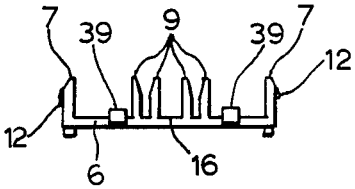

As seen in FIGS. 11 through 13, the floor extension 16 is quite similar in construction to a floor 1. The floor extension 16 comprises a base 6, sides 7, and fuse holder positioning members 9. Like the floor 1, the sides 7 of the floor extension 16 are provided with spacing members 10, indentations 11 and tabs 12 to accomodate connection of a cage 2 as described previously. One end of the base 6 of floor extension 16 is provided with a mounting hole 14 and a pair of extension holes 15. The other end of said base 6 is provided with a mounting hole 14 and a pair of tabs 38. The ends of tabs 38 are provided with projections 39 which may be inserted into the extension holes 15 of a floor 1 or of another floor extension 16.

One or more floor extensions 16 may be added to either end of a floor 1 to provide a longer floor subassembly and thus provide for the accomodation of more than six fuses. This may be illustrated in the following example which uses one floor extension 16 to provide a fuse block that may accomodate up to nine miniature blade-type fuses.

The fuse block of this example is assembled by inserting the projections 39 of a floor extension 16 into the extension holes 15 at one end of a floor 1. The fuse block is provided with a ten-position bussed fuse holder 3 having three fuse holders 27 on one side of the buss connect member 26 and six fuse holders 27 on the other side of member 26. A terminal lug 5 is attached to the bus connect member 26 as described previously, and the bussed fuse holder 3 is inserted into the space between the fuse holder positioning members 9 of floor 1 and the corresponding positioning members 9 of floor extension 16 so that the main terminal lug 5 rests on a terminal platform 8. Three cage and fuse holder subassemblies are assembled as described previously from three cages 2 and nine single-connect fuse holders 4. Two of the three cage and fuse holder subassemblies are attached to the floor 1 as described previously. The indentation 25 of the end 20 of one of the cages 2 accomodate and hold in position the tabs 38 of the floor extension 16, securing said floor extension 16 to said floor 1. The extended portion of the bussed fuse holder 3 is accomodated by an indentation 24 of said cage 2. The third cage and fuse holder subassembly is attached to the floor extension 16 and is held in place by contact between tabs 12 of the floor extension 16 and tabs 13 of the cage 2.

A second example of this preferred embodiment is a fuse block that may accomodate up to twelve minature blade-type fuses. The fuse block of this example comprises a first floor extension 16 attached to a first end of a floor 1, a second floor extension 16 attached to a second end of said floor 1, a thirteen-position bussed fuse holder 3 having six fuse holders 27 on either side of a bus connect member 26, a terminal lug 5, four cages 2 and twelve single-connect fuse holders 4. The terminal lug 5 and bussed fuse holder 3 are assembled as described previously, and the bussed fuse holder 3 is inserted between fuse holder positioning members 9 as described previously. The cages 2 and single-connect fuse holders 4 are assembled into subassemblies as described previously. Two cage and fuse holder subassemblies are attached to said floor 1, and one cage and fuse holder subassembly is attached to each floor extension 16 as described previously.

A fourth preferred embodiment of the fuse block that I have invented combines the desirable features of the second and third embodiments just described. This fourth embodiment comprises a fuse block having one or more floor extensions 16 and a corresponding number of additional cage and fuse holder subassemblies in which some or all of the fuse holders 27 are replaced by single-connect fuse holders 4.

Figure 15:
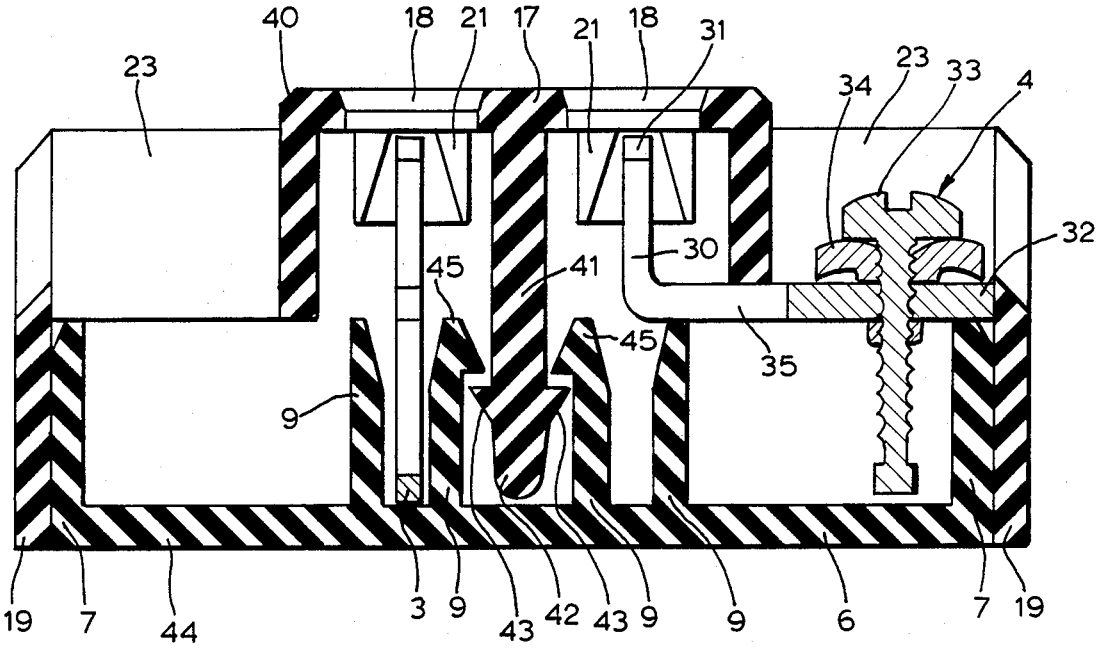
FIG. 15 is a sectional elevational view of an assembled fuse block showing an optional means of attaching a cage to a floor.

As seen in FIG. 15, a fifth preferred embodiment of the fuse block that i have invented includes an optional means of securing a cage to a floor. In this embodiment a cage 40 additionally is provided with a locking bar 41. Said bar 41 comprises a central bar 42 attached to the bottom surface of the top 17 and two tabs 43 attached near the bottom of said bar 42. A floor 44 additionally is provided with tabs 45 attached to two of the fuse holder positioning members 9. When such a cage 40 is attached to a floor 44, the locking bar 41 is inserted into the space between said tabs 45 of floor 44 and is held in place by the engagement of said tabs 43 with said tabs 45. To remove said cage 40 from said floor 44, a probe-like tool may be inserted into an opening 18 in the cage 40 to spread the gap between tabs 45 to release the bar 41.

I claim:

1. A fuse block comprising a floor comprising
- a floor base,
- a first floor side attached to a first side of said floor base,
- a second floor side attached to a second side of said floor base, and
- a plurality of fuse holder positioning members attached to said floor base;

a multi-position bussed fuse holder, inserted between a pair of said fuse holder positioning members of said floor, comprising
- a bus bar, and
- a plurality of fuse holders, each comprising
  - a first and second fuse holder arm, attached to said bus bar, having an exterior side indentation and an interior side indentation,
  - a contact point attached near the end on the interior of said first fuse holder arm, and
  - a contact point attached near the end on the interior of said second fuse holder arm;

a plurality of single-connect fuse holders, insulated from each other, held in proximity to a fuse holder positioning member of said floor, comprising
- a fuse holder base,
- means of attaching a wire to said fuse holder base,
- a first torsion arm attached to said fuse holder base near a first corner of a first edge of said fuse holder base,
- a second torsion arm attached to said fuse holder base near a second corner of said first edge of said fuse holder base in an approximately parallel configuration to said first torsion arm,
- a first fuse holder arm attached to said first torsion arm,
- a second fuse holder arm attached to said second torsion arm,
- a contact point attached near the end on the interior of said first fuse holder arm, and
- a contact point attached near the end on the interior of said second fuse holder arm; and a cage, attached to said floor, comprising
- a cage top having a plurality of openings,
- a plurality of fuse holder positioning members attached to the bottom surface of said cage top in pairs in proximity to said openings in said cage top,
- a first and second cage end attached to said cage top,
- a first and second upper cage side attached to said cage top and said cage ends,
- a first and second lower cage side attached to said cage ends, and
- a terminal box partition attached to said upper cage side and said lower cage side.

2. The fuse block of claim 1, further comprising means of attaching a wire to said multi-position bussed fuse holder.

3. The fuse block of claim 1, further comprising a main terminal platform attached to said base of said floor.

4. The fuse block of claim 1, wherein: said base of said floor is a base having a mounting hole.

5. The fuse block of claim 1, wherein: said base of said floor is a base having a floor extension holding hole.

6. The fuse block of claim 1, further comprising
- a tab attached to the exterior of a side of said floor, and
- a tab attached to the interior of said lower cage side and engaging said tab of said side of said floor.

7. The fuse block of claim 1, further comprising
- a bar attached to the bottom of said top of said cage,
- a tab attached near the bottom of said bar, and
- a tab attached to a fuse holder positioning member of said floor and engaging said tab of said bar.

8. The fuse holder of claim 1, wherein: said fuse holder positioning members of said floor are four or more wall-like members attached or said base of said floor in a configuration of sets of pairs of members aligned approximately parallel to a side of said floor.

9. The fuse block of claim 1, wherein: said top of said cage is a top having a plurality of beveled rectangular openings arranged in pairs with the short sides of the rectangular openings adjacent.

10. The fuse block of claim 1, further comprising a floor extension, attached to said floor, comprising
- a floor extension base,
- a first and second floor extension side attached to said floor extension base.
- a plurality of fuse holder positioning members attached to said floor extension base, and
- means of attaching a cage to said floor extension.

11. A fuse block comprising a floor comprising
- a floor base having a mounting hole,
- a first and second floor side attached to a first side of said floor base,
- a third and fourth floor side attached to a second side of said floor base,
- a first, second, third and fourth tab attached respectively to the exterior of said first, second, third and fourth floor sides,
- a first main terminal platform attached to said floor base between said first and second sides,
- a second main terminal platform attached to said floor base between said third and said fourth floor sides, and
- a plurality of wall-like fuse holder positioning members attached to said floor base in sets of pairs of members aligned approximately parallel to a floor side;

a multi-position bussed fuse holder, inserted between a pair of said fuse holder positioning members of said floor, comprising
- a bus bar,
- a plurality of fuse holders, each comprising
  - a first and second fuse holder arm, attached to said bus bar, having an exterior side indentation and an interior side indentation,
  - a contact point attached near the end on the interior of said first fuse holder arm, and
  - a contact point attached near the end on the interior of said second fuse holder arm, and a bus connect member attached to the bus bar in a configuration approximately perpendicular to said fuse holders;

a main terminal lug attached to said bus connect member and held in proximity to a main terminal platform of said floor;

a plurality of single-connect fuse holders, held in proximity to a fuse holder positioning member of said floor, comprising a fuse holder base, a captive screw attached to said fuse holder base, a floating captive washer attached to said captive screw, a first torsion arm attached to said fuse holder base near a first corner of a first edge of said fuse holder base, a second torsion arm attached to said fuse holder base near a second corner of said first edge of said fuse holder base in an approximately parallel configuration to said first torsion arm, a first fuse holder arm attached to said first torsion arm, a second fuse holder arm attached to said second torsion arm, a contact point attached near the end on the interior of said first fuse holder arm, and a contact point attached near the end on the interior of said second fuse holder arm; and a cage, attached to said floor, comprising a cage top having a plurality of beveled, rectangular, openings of approximately equal size arranged in pairs with the short sides of the rectangular openings adjacent, a plurality of U-shaped fuse holder positioning members attached to the bottom surface of said cage top in pairs in proximity to said openings in said cage top, a first and second cage end attached to said cage top, a first and second upper cage side attached to said cage top and said cage ends, a first and second lower cage side attached to said cage ends, a terminal box partition attached to said upper cage side and said lower cage side, and a first and second tab attached respectively to said first and second lower cage side and engaging said corresponding tab of said floor side.

* * * * *